US006182033B1

(12) United States Patent
Accardi et al.

(10) Patent No.: US 6,182,033 B1
(45) Date of Patent: Jan. 30, 2001

(54) MODULAR APPROACH TO SPEECH ENHANCEMENT WITH AN APPLICATION TO SPEECH CODING

(75) Inventors: Anthony J. Accardi, Somerset; Richard Vandervoort Cox, New Providence, both of NJ (US)

(73) Assignee: AT&T Corp., New York, NY (US)

( * ) Notice: Under 35 U.S.C. 154(b), the term of this patent shall be extended for 0 days.

(21) Appl. No.: 09/120,412

(22) Filed: Jul. 22, 1998

Related U.S. Application Data

(60) Provisional application No. 60/071,051, filed on Jan. 9, 1998.

(51) Int. Cl.[7] ..... G10L 19/00; G10L 19/06

(52) U.S. Cl. ..... 704/223; 704/219; 704/226

(58) Field of Search ..... 704/223, 219, 704/220, 221, 226

(56) References Cited

U.S. PATENT DOCUMENTS 4,472,832 9/1984 Atal et al. ..... 381/40
5,495,555 * 2/1996 Swaminathan ..... 704/207

FOREIGN PATENT DOCUMENTS 0 732 687 9/1996 (EP) .
0 742 548 11/1996 (EP) .

OTHER PUBLICATIONS

JP 08 130513A (Abstract).

* cited by examiner

*Primary Examiner*—David R. Hudspeth
*Assistant Examiner*—Susan Wieland

(57) ABSTRACT

A speech coder separates input digitized speech into component parts on an interval by interval basis. The component parts include gain components, spectrum components and excitation signal components. A set of speech enhancement systems within the speech coder processes the component parts such that each component part has its own individual speech enhancement process. For example, one speech enhancement process can be applied for analyzing the spectrum components and another speech enhancement process can be used for analyzing the excitation signal components.

15 Claims, 2 Drawing Sheets

MODULAR APPROACH TO SPEECH ENHANCEMENT WITH AN APPLICATION TO SPEECH CODING

CROSS-REFERENCE TO RELATED APPLICATIONS

This application claims the priority benefit of provisional U.S. application Ser. No. 60/071,051, filed Jan. 9, 1998.

BACKGROUND OF THE INVENTION

There are many environments where noisy conditions interfere with speech, such as the inside of a car, a street, or a busy office. The severity of background noise varies from the gentle hum of a fan inside a computer to a cacophonous babble in a crowded cafe. This background noise not only directly interferes with a listener's ability to understand a speaker's speech, but can cause further unwanted distortions if the speech is encoded or otherwise processed. Speech enhancement is an effort to process the noisy speech for the benefit of the intended listener, be it a human, speech recognition module, or anything else. For a human listener, it is desirable to increase the perceptual quality and intelligibility of the perceived speech, so that the listener understands the communication with minimal effort and fatigue.

It is usually the case that for a given speech enhancement scheme, a tradeoff must be made between the amount of noise removed and the distortion introduced as a side effect. If too much noise is removed, the resulting distortion can result in listeners preferring the original noise scenario to the enhanced speech. Preferences are based on more than just the energy of the noise and distortion: unnatural sounding distortions become annoying to humans when just audible, while a certain elevated level of "natural sounding" background noise is well tolerated. Residual background noise also serves to perceptually mask slight distortions, making its removal even more troublesome.

Speech enhancement can be broadly defined as the removal of additive noise from a corrupted speech signal in an attempt to increase the intelligibility or quality of speech. In most speech enhancement techniques, the noise and speech are generally assumed to be uncorrelated. Single channel speech enhancement is the simplest scenario, where only one version of the noisy speech is available, which is typically the result of recording someone speaking in a noisy environment with a single microphone.

FIG. 1 illustrates a speech enhancement setup for N noise sources for a single-channel system. For the single channel case illustrated in FIG. 1, exact reconstruction of the clean speech signal is usually impossible in practice. So speech enhancement algorithms must strike a balance between the amount of noise they attempt to remove and the degree of distortion that is introduced as a side effect. Since any noise component at the microphone cannot in general be distinguished as coming from a specific noise source, the sum of the responses at the microphone from each noise source is denoted as a single additive noise term.

Speech enhancement has a number of potential applications. In some cases, a human listener observes the output of the speech enhancement directly, while in others speech enhancement is merely the first stage in a communications channel and might be used as a preprocessor for a speech coder or speech recognition module. Such a variety of different application scenarios places very different demands on the performance of the speech enhancement module, so any speech enhancement scheme ought to be developed with the intended application in mind. Additionally, many well-known speech enhancement processes perform very differently with different speakers and noise conditions, making robustness in design a primary concern. Implementation issues such as delay and computational complexity are also considered.

Speech can be modeled as the output of an acoustic filter (i.e., the vocal tract) where the frequency response of the filter carries the message. Humans constantly change properties of the vocal tract to convey messages by changing the frequency response of the vocal tract.

The input signal to the vocal tract is a mixture of harmonically related sinusoids and noise. "Pitch" is the fundamental frequency of the sinusoids. "Formants" correspond to the resonant frequency(ies) of the vocal tract.

A speech coder works in the digital domain, typically deployed after an analog-to-digital (A/D) converter, to process a digitized speech input to the speech coder. The speech coder breaks the speech into constituent parts on an interval-by-interval basis. Intervals are chosen based on the amount of compression or complexity of the digitized speech. The intervals are commonly referred to as frames or sub-frames. The constituent parts include: (a) gain components to indicate the loudness of the speech; (b) spectrum components to indicate the frequency response of the vocal tract, where the spectrum components are typically represented by linear prediction coefficients ("LPCs") and/or cepstral coefficients; and (c) excitation signal components, which include a sinusoidal or periodic part, from which pitch is captured, and a noise-like part.

To make the gain components, gain is measured for an interval to normalize speech into a typical range. This is important to be able to run a fixed point processor on the speech.

In the time domain, linear prediction coefficients (LPCs) are a weighted linear sum of previous data used to predict the next datum. Cepstal coefficients can be determined from the LPCs, and vice versa. Cepstral coefficients can also be determined using a fast Fourier transform (FFT).

The bandwidth of a telephone channel is limited to 3.5 kHz. Upper (higher-frequency) formants can be lost in coding.

Noise affects speech coding, and the spectrum analysis can be adversely affected. The speech spectrum is flattened out by noise, and formants can be lost in coding. Calculation of the LPC and the cepstral coefficients can be affected.

The excitation signal (or "residual signal") components are determined after or separate from the gain components and the spectrum components by breaking the speech into a periodic part (the fundamental frequency) and a noise part. The processor looks back one (pitch) period (I/F) of the fundamental frequency (F) of the vocal tract to take the pitch, and makes the noise part from white noise. A sinusoidal or periodic part and a noise-like part are thus obtained.

Speech enhancement is needed because the more the speech coder is based on a speech production model, the less able it is to render faithful reproductions of non-speech sounds that are passed through the speech coder. Noise does not fit traditional speech production models. Non-speech sounds sound peculiar and annoying. The noise itself may be considered annoying by many people. Speech enhancement has never been shown to improve intelligibility but has often been shown to improve the quality of uncoded speech.

According to previous practice, speech enhancement was performed prior to speech coding, in a speech enhancement system separated from a speech coder/decoder, as shown in FIG. 2. With reference to FIG. 2, the speech enhancement module 6 is separated from the speech coder/decoder 8. The speech enhancement module 6 receives input speech. The speech enhancement module 6 enhances (e.g., removes noise from) the input speech and produces enhanced speech.

The speech coder/decoder 8 receives the already enhanced speech from the speech enhancement module 6. The speech coder/decoder 8 generates output speech based on the already-enhanced speech. The speech enhancement module 6 is not integral with the speech coder/decoder 8.

Previous attempts at speech enhancement and coding first cleaned up the speech as a whole, and then coded it, setting the amount of enhancement via "tuning".

SUMMARY OF THE INVENTION

According to an exemplary embodiment of the invention, a system for enhancing and coding speech performs the steps of receiving digitized speech and enhancing the digitized speech to extract component parts of the digitized speech. The digitized speech is enhanced differently for each of the component parts extracted.

According to an aspect of the invention, an apparatus for enhancing and coding speech includes a speech coder that receives digitized speech. A spectrum signal processor within the speech coder determines spectrum components of the digitized speech. An excitation signal processor within the speech coder determines excitation signal components of the digitized speech. A first speech enhancement system within the speech coder processes the spectrum components. A second speech enhancement system within the speech coder processes the excitation signal components.

Other features and advantages of the invention will become apparent from the following detailed description, taken in conjunction with the accompanying drawings, which illustrate, by way of example, the features of the invention.

DETAILED DESCRIPTION

Previous speech enhancement techniques were separated from, and removed noise prior to, speech coding. According to the principles of the invention, a speech enhancement system is integral with a speech coder such that differing speech enhancement processes are used for particular (e.g., gain, spectrum and excitation) components of the digitized speech while the speech is being coded.

Speech enhancement is performed within the speech coder using one speech enhancement system as a preprocessor for the LPC filter computer and a different speech enhancement system as a preprocessor for the speech signal from which the residual signal is computed. The two speech enhancement processes are both within the speech coder. The combined speech enhancement and speech coding method is applicable to both time-domain coders and frequency-domain coders.

Figure 1:
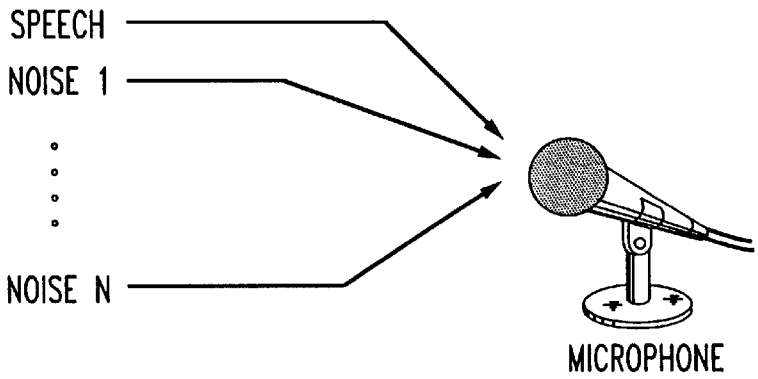
FIG. 1 PRIOR ART
FIG. 1 illustrates a speech enhancement setup for N noise sources for a singlechannel system.
Figure 2:
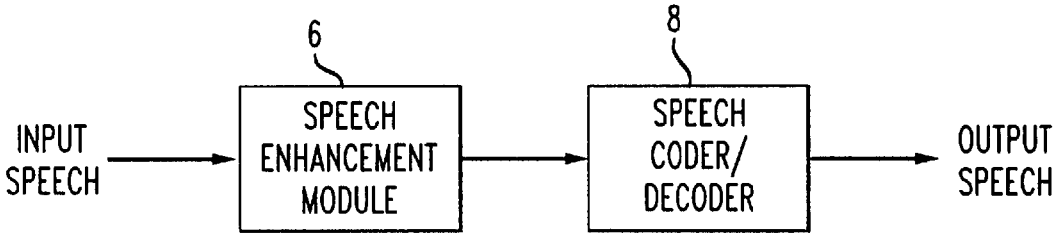
FIG. 2 PRIOR ART
FIG. 2 illustrates a conventional speech enhancement and coding system.
Figure 3:
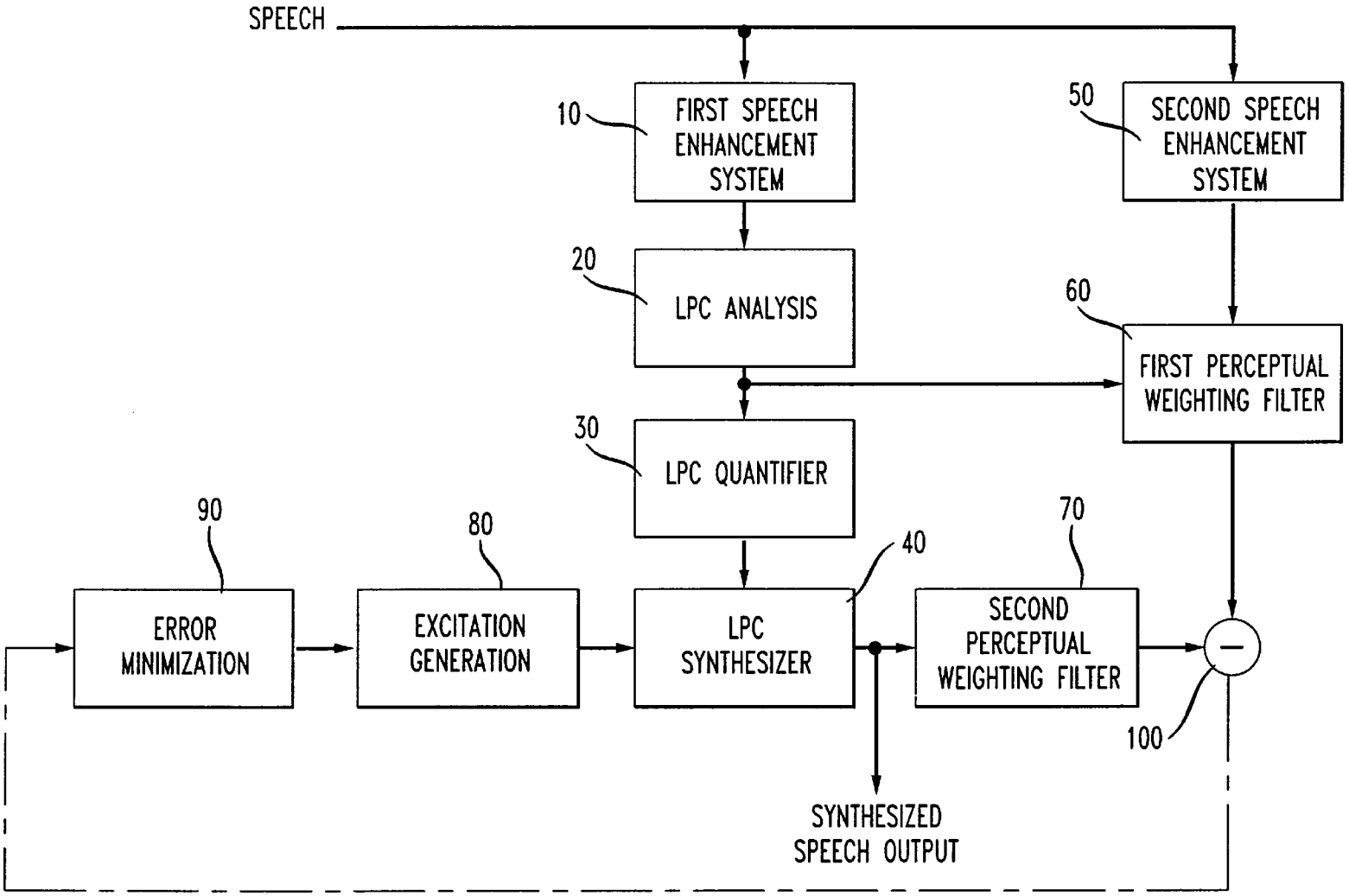
FIG. 3 illustrates a speech enhancement and coding system in accordance with the principles of the invention.

FIG. 3 is a schematic view of an apparatus which integrates speech enhancement into a speech coder in accordance with the principles of the invention. The apparatus illustrated in FIG. 3 includes a first speech enhancement system 10. The first speech enhancement system 10 receives an input speech signal which has been digitized. An LPC analysis computer (LPC analyzer) 20 is coupled to the first speech enhancement system 10. An LPC quantizer 30 is coupled to the LPC analysis computer 20. An LPC synthesis filter (LPC synthesizer) 40 is coupled to the LPC quantizer 30.

A second speech enhancement system 50 receives the digitized input speech signal. A first perceptual weighting filter 60 is coupled to the second speech enhancement system 50 and to the LPC analyzer 20. A second perceptual weighting filter 70 is coupled to the LPC analyzer 20 and to the LPC synthesizer 40.

A subtractor 100 is coupled to the first perceptual weighting filter 60 and the second perceptual weighting filter 70. The subtractor 100 produces an error signal based on the difference of two inputs. An error minimization processor 90 is coupled to the subtractor 100. An excitation generation processor 80 is coupled to the error minimization processor 90. The LPC synthesis filter 40 is coupled to the excitation generation processor 80.

The first speech enhancement system 10 and the second speech enhancement system 50 are integral with the rest of the apparatus illustrated in FIG. 3. The first speech enhancement system 10 and the second speech enhancement system 50 can be entirely different or can represent different "tunings" that give different amounts of enhancement using the same basic system.

The first speech enhancement system 10 enhances speech prior to computation of spectral parameters, which in this example is an LPC analysis. The LPC analysis system 20 carries out the LPC spectral analysis. The LPC analysis system 20 determines the best acoustic filter, which is represented as a sequence of LPC parameters. The output LPC parameters of the LPC spectral analysis are used for two different purposes in this example.

The unquantized LPC parameters are used to compute coefficient values in the first perceptual weighting filter 60 and the second perceptual weighting filter 70.

The unquantized LPC values are also quantized in the LPC quantizer 30. The LPC quantizer 30 produces the best estimate of the spectral information as a series of bits. The quantized values produced by the LPC quantizer 30 are used as the filter coefficients in the LPC synthesis filter (LPC synthesizer) 40. The LPC synthesizer 40 combines the excitation signal, indicating pulse amplitudes and locations, produced by the excitation generation processor 80 with the quantized values representing the best estimate of the spectral information that are output from the LPC quantizer 30.

The second speech enhancement system 50 is used in determining the excitation signal produced by the excitation generation processor 80. The digitized speech signal is input to the second speech enhancement system 50. The enhanced speech signal output from the second speech enhancement system 50 is perceptually weighted in the first perceptual weighting filter 60. The first perceptual weighting filter 60 weights the speech with respect to perceptual quality to a listener. The perceptual quality continually changes based on the acoustic filter (i.e., based on the frequency response of the vocal tract) represented by the output of the LPC analyzer 20. The first perceptual weighting filter 60 thus operates in the psychophysical domain, in a "perceptual space" where mean square error differences are relevant to the coding distortion that a listener hears.

According to the exemplary embodiment of the invention illustrated in FIG. 3, all possible excitation sequences are generated in the excitation generation processor 80. The possible excitation sequences generated by excitation generator 80 are input to the LPC synthesizer 40. The LPC synthesizer 40 generates possible coded output signals based on the quantized values representing the best estimate of the spectral information generated by LPC quantizer 30 and the possible excitation sequences generated by excitation generation processor 80. The possible coded output signals from the LPC synthesizer 40 can be sent to a digital to analog (A/D) converter for further processing.

The possible coded output signals from the LPC synthesizer 40 are passed through the second perceptual weighting filter 70. The second perceptual weighting filter 70 has the same coefficients as the first perceptual weighting filter 60. The first perceptual weighting filter 60 filters the enhanced speech signal whereas the second perceptual weighting filter 70 filters possible speech output signals. The second perceptual weighting filter 70 tries all of the different possible excitation signals to get the best decoded speech.

The perceptually weighted possible output speech signals from the second perceptual weighting filter 70 and the perceptually weighted enhanced input speech signal from the first perceptual weighting filter 60 are input to the subtractor 100. The subtractor 100 determines a signal representing a difference between perceptually weighted possible output speech signals from the second perceptual weighting filter 70 and the perceptually weighted enhanced input speech signal from the first perceptual weighting filter 60. The subtractor 100 produces an error signal based on the signal representing such difference.

The output of the subtractor 100 is coupled to the error minimization processor 90. The error minimization processor 90 selects the excitation signal that minimizes the error signal output from the subtractor 100 as the optimal excitation signal. The quantized LPC values from LPC quantizer 30 and the optimal excitation signal from the error minimization processor 90 are the values that are transmitted to the speech decoder and can be used to re-synthesize the output speech signal.

The first speech enhancement system 10 and the second speech enhancement system 50 within the apparatus illustrated in FIG. 3 can (i) apply differing amounts of the same speech enhancement process, or (ii) apply different speech enhancement processes.

The principles of the invention can be applied to frequency-domain coders as well as time-domain coders, and are particularly useful in a cellular telephone environment, where bandwidth is limited. Because the bandwidth is limited, transmissions of cellular telephone calls use compression and often require speech enhancement. The noisy acoustic environment of a cellular telephone favors the use of a speech enhancement process. Generally, speech coders that use a great deal of compression need a lot of speech enhancement, while those using less compression need less speech enhancement.

Examples of recent speech enhancement schemes which can be used as the first and second speech enhancement systems 10, 50 are described in the article by E. J. Diethorn, "A Low-Complexity, Background-Noise Reduction Preprocessor for Speech Encoders," presented at IEEE Workshop on Speech Coding for Telecommunications, Pocono Manor Inn, Pocono Manor, Pa., 1997; and in the article by T. V. Ramabadran, J. P. Ashley, and M. J. McLaughlin, "Background Noise Suppression for Speech Enhancement and Coding," presented at IEEE Workshop on Speech Coding for Telecommunications, Pocono Manor in, Pocono Manor, Pa., 1997. The latter article describes the enhancement system prescribed for use in the Interim Standard 127 (IS-127) promulgated by the Telecommunications Industry Association (TIA).

The invention combines the strengths of multiple speech enhancement systems in order to generate a robust and flexible speech enhancement and coding process that exhibits better performance. Experimental data indicate that a combination enhancement approach leads to a more robust and flexible system that shares the benefits of each constituent speech enhancement process.

While several particular forms of the invention have been illustrated and described, it will also be apparent that various modifications can be made without departing from the spirit and scope of the invention.

What is claimed is:

1. An apparatus that enhances and codes a digitized speech signal comprising:

a speech coder that receives, as an input, the digitized speech signal and breaks the digitized speech signal into constituent parts, wherein the speech coder comprises:

a first speech enhancement system that enhances the digitized speech signal and produces a first enhanced digitized speech signal;

a spectrum signal processor that computes spectral parameters by processing the first enhanced digitized speech signal;

a second speech enhancement system that enhances the digitized speech signal and produces a second enhanced digitized speech signal; and an excitation generation processor that determines an excitation signal by processing the second enhanced digitized speech signal.

2. The apparatus of claim 1, wherein the spectrum signal processor includes a quantizer.

3. The apparatus of claim 1, wherein the spectral parameters are represented by linear prediction coefficients.

4. The apparatus of claim 1, wherein the spectral parameters are represented by cepstral coefficients.

5. The apparatus of claim 1, wherein the excitation signal includes a periodic part, from which pitch is captured, and a noise-like part.

6. A method that enhances and codes a digitized speech signal by receiving, as an input, the digitized speech signal and breaking the digitized speech signal into constituent parts, wherein the method comprises the steps of:

enhancing the digitized speech signal using a first speech enhancement system to produce a first enhanced digitized speech signal;

computing spectral parameters by processing the first enhanced digitized speech signal using a spectrum signal processor;

enhancing the digitized speech signal using a second speech enhancement system to produce a second enhanced digitized speech signal; and determining an excitation signal by processing the second enhanced digitized speech signal using an excitation generation processor.

7. The method of claim 6, wherein the spectrum signal processor in the computing step includes a quantizer.

8. The method of claim 6, wherein the spectral parameters are represented by linear prediction coefficients.

9. The method of claim 6, wherein the spectral parameters are represented by cepstral coefficients.

10. The method of claim 6, wherein the excitation signal includes a periodic part, from which pitch is captured, and a noise-like part.

11. A method that enhances and codes a digitized speech signal by receiving, as an input, the digitized speech signal and breaking the digitized speech signal into constituent parts, wherein the method comprises the steps of:

enhancing the digitized speech signal by applying at least two speech enhancement processes to produce at least two enhanced digitized speech signals; and computing a coded speech signal by processing the at least two enhanced digitized speech signals.

12. A speech coder, comprising:

a receiving means that receives a digitized speech signal;

a first enhancing means that enhances the digitized speech signal and produces a first enhanced digitized speech signal;

a second enhancing means that enhances the digitized speech signal and produces a second enhanced digitized speech signal; and a computing means that computes the coded speech signal using the first enhanced digitized speech signal and the second enhanced digitized speech signal.

13. The speech coder of claim 12, wherein the first enhancing means and the second enhancing means enhance the digitized speech signal by applying differing amounts of the same speech enhancement process.

14. The speech coder of claim 12, wherein the first enhancing means and the second enhancing means enhance the digitized speech signal by applying different speech enhancement processes.

15. The speech coder of claim 12, wherein the first enhancing means includes a spectral analysis of the digital speech signal and the second enhancing means includes excitation signal processing of the digital speech signal.

* * * * *